United States Patent [19]

Ono

[11] Patent Number: 4,964,169

[45] **Date of Patent: * Oct. 16, 1990**

[54] METHOD AND APPARATUS FOR SPEECH CODING

[75] Inventor: Shigeru Ono, Tokyo, Japan

[73] Assignee: NEC Corporation, Tokyo, Japan

[ * ] Notice: The portion of the term of this patent subsequent to May 26, 2004 has been disclaimed.

[21] Appl. No.: 310,464

[22] Filed: Feb. 15, 1989

Related U.S. Application Data

[63] Continuation of Ser. No. 697,197, Feb. 1, 1985, abandoned.

[30] Foreign Application Priority Data

Feb. 2, 1984 [JP] Japan ..... 59-17347
May 8, 1984 [JP] Japan ..... 59-91252

[51] Int. Cl.[5] ..... G10L 9/08
[52] U.S. Cl. ..... 381/40
[58] Field of Search ..... 364/513.5; 381/29–40, 381/49

[56] References Cited

U.S. PATENT DOCUMENTS 4,220,819 9/1980 Atal ..... 381/38
4,282,406 8/1981 Yato et al. ..... 381/49
4,472,832 9/1984 Atal et al. ..... 381/40
4,669,120 5/1987 Ono ..... 381/40

OTHER PUBLICATIONS

IRE Trans. Inform., Theory, vol. IT-6, "Quantizing for Minimum Distortion", Joel Max, Mar. 1960.
Proceedings of the IEEE, vol. 63, No. 4, "Linear Prediction: A Tutorial Review", John Makhoul, Apr. 1975.
"A New Model of LPC Excitation for Producing Natural-Sounding Speech at Low Bit Rates", Bishnu S. Atal and Joel R. Remde; Bell Laboratories, Murray Hill, N.J., 1982.
"Digital Proceedings of Speech Signals", by L. R. Rabiner and R. W. Schafer, *Prentice-Hall Signal Processing Series*, pp. 396–407, 1978.

*Primary Examiner*—Gary V. Harkcom
*Assistant Examiner*—David D. Knepper
*Attorney, Agent, or Firm*—Sughrue, Mion, Zinn, Macpeak & Seas

[57] ABSTRACT

A low bit rate speech coding method and implementing apparatus in which a linear predictive coding (LPC) speech synthesizer receives an excitation sequence comprised of pulses having selected amplitudes at predetermined positions within a frame to minimize the weighted mean square error between the synthetic speech produced by the LPC synthesizer and the input speech. Pulse locations and the pulse amplitudes at the respective locations are determined by a sequential processing technique in which the amplitude and location of each pulse are determined in accordance with the previously determined amplitudes and locations of the pulses preceeding the present pulse in the same frame; and specifically by determining the amplitude $g_k$ and location $l_k$ of a new pulse in a frame from selected pulses S at locations k−1 through k-S close to location $l_k$. The number S of preceeding pulses used to determine the pulse at location $l_k$ is selected such that the distance between the Sth pulse preceeding the pulse at location $l_k$ affects the determination of the pulse at $l_k$ while pulses prior to the Sth pulse have no appreciable effect on the determination of the pulse at $l_k$. That is, each of the S pulses within a threshold distance $T_{th}$ is judged to effect the detection of the pulse at $l_k$ while pulses preceeding the pulse at $l_k$ and outside of the range $T_{th}$ are judged to not effect the determination of the pulse at $l_k$.

8 Claims, 7 Drawing Sheets

METHOD AND APPARATUS FOR SPEECH CODING

This is a continuation of application Ser. No. 697,197, filed Feb. 1, 1985, now abandoned.

BACKGROUND OF THE INVENTION

This invention relates to a method and an apparatus for low bit rate speech signal coding.

There is a known method for searching an excitation sequence of a speech signal at short time intervals as one effective speech signal coding at a transmission rate of 10 kbps or less, provided that an error in the signal reproduced using the sequence relative to the input signal is minimal. The A-b-S (Analysis-by-Synthesis) method (prior art 1) proposed by B. S. Atal at Bell Telephone Laboratories of the United States is worth notice, in that the excitation sequence is represented by a plurality of pulses with the amplitudes as well as phases are obtained on the coder side at short time intervals through that method. The detailed description of the method will be omitted herein as it appeared in the manuscript collection (ICASSP, 1982) on pp. 614~617 (reference 1); "A new model of LPC excitation for producing natural-sounding speech at low bit rates". The disadvantage of the conventional method referred to as prior art 1 is that the calculation amount would become larger since the A-b-S method has been employed to obtain the pulse sequence. On the other hand, there has been proposed another method (prior art 2) using correlation functions to obtain the pulse sequence, this method being intended to decrease the calculation amount (U.S. patent application Ser. No. 565,804 and Canadian Application No. 444,239). Excellent reproduced sound quality is available for the transmission rate of 10 kbps or less.

The conventional method using the correlation functions will briefly be described. The excitation sequence comprising k pieces of pulse sequence within a frame is represented by the following:

$$d(n) = \sum_{k=1}^{K} g_k \delta(n - l_k),\ n = 0, 1, \ldots, N-1 \tag{1}$$

where $\delta(\cdot)=\delta$ of KRONECKER; N=frame length; and $g_k$=pulse amplitude at location $l_k$. If a predictive coefficient is assumed $\alpha_i$ (i=1, . . . , M, M being the order of the synthesis filter), the reproduced signal $\tilde{x}(n)$ obtained by inputting d(n) to the synthesis filter can be written as:

$$\tilde{x}(n) = d(n) + \sum_{i=1}^{M} \alpha_i \tilde{x}(n-i) \tag{2}$$

The weighted mean squared error between the input speech signal x(n) and the reproduced signal $\tilde{x}(n)$ within one frame is given by:

$$J = \sum_{n=0}^{N-1} ((x(n) - \tilde{x}(n)) * W(n))^2 \tag{3}$$

where * represents convolutional integration; and w(n) weighting function. The weighting function is introduced to minimize the audio error in the reproduced speech. According to the audio masking effect, noise tends to be suppressed in a zone where the speech energy is greater The weighting function is determined based on the audiocharacteristics. As the weighting function there is proposed the Z-transform function W(z) using the real constant $\gamma$ and the predictive parameter $\alpha_i$ of the synthesis filter under the condition of $0 \leqq \gamma \leqq 1$ (see the reference 1).

$$W(z) = \left(1 - \sum_{i=1}^{M} \alpha_i Z^{-i}\right) / \left(1 - \sum_{i=1}^{M} \alpha_i \gamma_i Z^{-i}\right)$$

If the Z-transform of the x(n) and $\tilde{x}(n)$ are respectively defined as X(z) and $\tilde{X}(z)$, the equation (3) will be represented by the following:

$$J = |X(z)W(z) - \tilde{X}(z)W(z)|^2 \tag{4}$$

With reference to the equation (2), $\tilde{x}(z)$ will be:

$$\tilde{X}(z) = H(z)D(z) \tag{5}$$

where;

$$H(z) = 1 / \left(1 + \sum_{i=1}^{M} \alpha_i Z^{-i}\right)$$

H(z) is a Z transform of the synthethis filter, and D(z) is a Z transformed excitation sequence. Substituting equation (5) into (4), the equation (6) is obtained.

$$J = |X(z)W(z) - H(z)W(z)D(z)|^2 \tag{6}$$

Accordingly, if the inverse Z transforms of X(z)W(z) and H(z)W(z) are written as $x_w(n)=x(n)*w(n)$ and $h_w(n)=h(n)*w(n)$, (6) will be:

$$J = \sum_{n=0}^{N-1} \left(x_w(n) - \sum_{k=1}^{K} g_k h_w(n - l_k)\right)^2 \tag{7}$$

by partially differentiating the equation (7) with $g_k$ and setting the result at 0, the following equation (8) is obtained.

$$g_k = \left(\psi_{xh}(l_k) - \sum_{i=1}^{k-1} g_i \phi_{hh}(l_i, l_k)\right) / \phi_{hh}(l_k, l_k) - k = 1, \ldots, K \tag{8}$$

where $\psi_{xh}(\cdot)$ expresses a cross-correlation function between the $x_w(n)$ and $h_w(n)$, and $\phi_{hh}(\cdot)$ an autocorrelation function of the $h_w(n)$. They are written as follow:

$$\psi_{xh}(l_k) = \sum_{n=0}^{N-1} x_w(n) h_w(n - l_k) = \psi_{hx}(-l_k) \tag{9}$$
$$0 \leqq l_k \leqq n - 1$$

$$\phi_{hh}(l_i, l_j) = \sum_{n=0}^{Q} h_w(n - l_i) h_w(n - l_j) \tag{10}$$
$$Q = N - (l_i - l_j) + 1,\ 0 \leqq l_i, l_j \leqq N - 1$$

The conventional method 2 (prior art 2) determines k-th pulse amplitude and location by assuming $g_k$ in the equation (8) as a function of only $l_k$. In other words, $l_k$ maximizing $|g_k|$ of the equation (8) is determined as the k-th pulse location and $g_k$ at $l_k$ as the k-th pulse amplitude. In this method, the excitation pulse sequence is calculated under the condition that the pulse amplitude $g_k$ is only a function of the location $l_k$. However, since $g_k$ is, generally, a function of $l_1, l_2, \ldots, l_k$, such a method is not an optimum one.

As described above, the excitation pulse sequence determined by the above-described conventional method is not applicable to the true minimization of J in the equation (7), whereby there exists a more suitable sound source pulse sequence. It is therefore necessary to obtain the amplitude and location of a more proper excitation pulse sequence.

The present inventor consequently has proposed a method (prior art 3) (U.S. patent application Ser. No. 626,949 and Canadian Application No. 458,282) for obtaining optimum pulse location and amplitude minimizing $J_w$ using data on the (first~(k−1)th) pulse locations and amplitudes when the k-th pulse location and amplitude are obtained. However, the calculation for obtaining the k-th pulse location and amplitude through the above-described method is tantamount to solving k×k symmetrical matrix and this would increase the calculation amount.

SUMMARY OF THE INVENTION

In view of the foregoing, it is an object of the present invention to provide a method for quality low bit rate speech coding.

It is another object of the present invention to provide a method for quality speech coding capable of remarkably reducing the calculation amount.

According to the present invention, there is provided a pulse coding method or apparatus for developing a new pulse location and amplitude sequentially based on the pulse location and amplitude previously obtained concerning a speech signal on a frame basis, comprising: a first step or means for selecting a pulse close to the location $l_k$ of said new pulse based on said pulses previously obtained, and a second step or means for developing said new pulse based on the selected pulse and coding at least said new pulse.

Other objects and features of the present invention will be clarified by the following description with reference to the drawings.

DETAILED DESCRIPTION OF THE PREFERRED EMBODIMENTS

Figure 1:
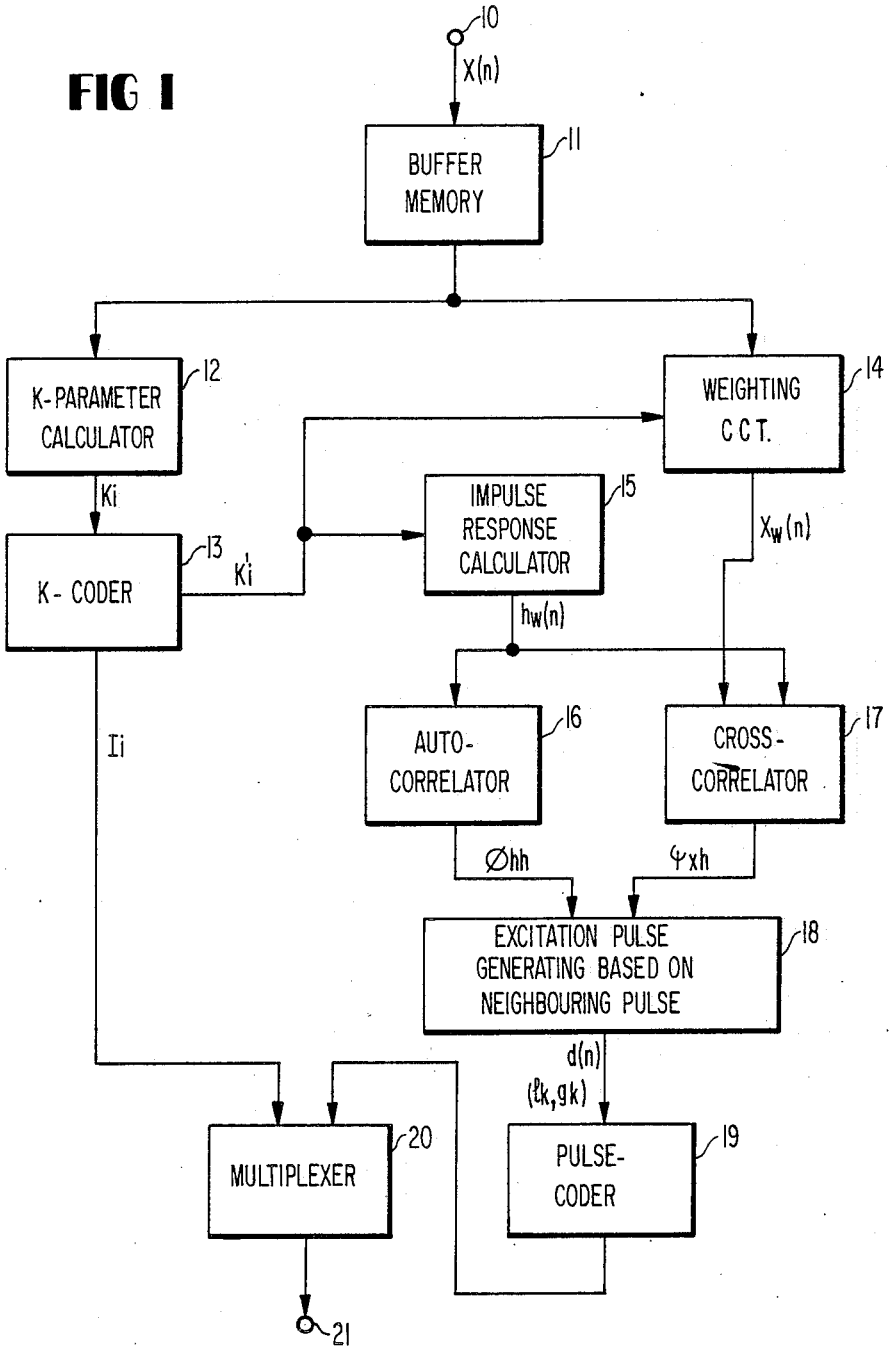
FIG. 1 is a block diagram illustrating an embodiment of the present invention.

The speech coding method according to the present invention is characterized in that, when pulses are sequentially obtained, it is based on pulse data available in the neighborhood (within the threshold distance or the number of data close to a new pulse location whose amplitude is to be determined) among those obtained up to then. Description of the first embodiment of the present invention is made of an algorithm for obtaining the amplitude $g_k$ and location $l_k$, k=1, . . . , K of an excitation pulse sequence minimizing J in the equation (7).

A weighted mean squared error is expressed as follows according to the equation (7) when one pulse is further added to the (k−1) pulses whose amplitudes and locations are respectively $\{g_1, g_2, \ldots g_{k-1}\}$ and $\{l_1, l_2 \ldots, l_{k-1}\}$.

$$J_k = \sum_{n=0}^{N-1} \left( x_w(n) - \sum_{i=1}^{k} g_i h_w(n - l_i) \right)^2 \tag{11}$$

If the equation (11) is partially differentiated with $g_k$ and set at 0 to examine the influence of the k-th pulse, the following relationship will be obtained.

$$g_k = \begin{cases} \dfrac{\psi_{xh}(l_k) - \sum_{i=1}^{k-1} g_i \phi_{hh}(l_i, l_k)}{\phi_{hh}(l_k, l_k)}, & (k > 1) \\ \dfrac{\psi_{xh}(l_k)}{\phi_{hh}(l_k, l_k)}, & (k = 1) \end{cases} \tag{12}$$

$J_k$ can be calculated in the following manner using $J_{k-1}$, $g_k$.

$$J_k = J_{k-1} - g_k^2/\phi_{hh}(l_k, l_k),\ k > 1 \tag{13}$$

where, $$J_{k-1} = \sum_{n=0}^{N-1} \left( x_w(n) - \sum_{i=1}^{k-1} g_i h_w(n - l_i) \right)^2 \tag{14}$$

In it understood from the equations (12) and (13) that $J_k$ becomes a function of $l_k$ and $J_k$ is minimized when the pulse is set at $l_k$ where $g_k^2$ is maximized. In other words, the location of the k-th pulse is determined as $l_k$ maximizing $g_k$ in the equation (12).

Subsequently, the equation (11) is partially differentiated with $g_k$ and set at 0 so as to obtain the following relationship:

$$\psi_{xh}(l_k) = \sum_{i=1}^{K} g_i \phi_{hh}(l_i, l_k),\ k = 1, \ldots, K \tag{15}$$

$g_k$, k=1, . . . , K satisfying the equation (15) are obtained by solving the following set of linear equations.

$$\begin{bmatrix} \phi_{hh}(l_1, l_1) & \cdots & \phi_{hh}(l_1, l_K) \\ \phi_{hh}(l_2, l_1) & \cdots & \phi_{hh}(l_2, l_K) \\ \cdot & & \\ \cdot & & \\ \cdot & & \\ \phi_{hh}(l_K, l_1) & \cdots & \phi_{hh}(l_K, l_K) \end{bmatrix} \begin{bmatrix} g_1 \\ g_2 \\ \cdot \\ \cdot \\ \cdot \\ g_K \end{bmatrix} = \begin{bmatrix} \psi_{xh}(l_1) \\ \psi_{xh}(l_2) \\ \cdot \\ \cdot \\ \cdot \\ \psi_{xh}(l_K) \end{bmatrix} \tag{16}$$

Since the auto-correlation function $\phi_{hh}(\cdot)$ of the impulse response sequence of the synthesis filter attenuates exponentially, the influence of $\phi_{hh}(\cdot)$ of large time lag on the equation (15) is negligible. Accordingly, it is possible to calculate the pulse sequence minimizing the equation (11) on the basis of the k-th pulse whose location has newly been determined and the pulses located close to the k-th pulse instead of solving the equations (16). It is to be noted here that the amplitudes of the pulse sequence sufficiently far from the k-th pulse are subjected to no change.

The equation (16) can be expressed by the following equation based on the k-th pulse and a sequence of S pulses located close thereto.

$$\begin{bmatrix} \phi_{hh}(l_{k-S}, l_{k-S}) \cdots \phi_{hh}(l_{k-S}, l_k) \\ \cdot \\ \cdot \\ \cdot \\ \phi_{hh}(l_k, l_{k-S}) \cdots \phi_{hh}(l_k, l_k) \end{bmatrix} \begin{bmatrix} g_{k-S} \\ \cdot \\ \cdot \\ \cdot \\ g_k \end{bmatrix} = \begin{bmatrix} \psi_{xh}(l_{k-S}) - \sum_{i=1}^{k-S-1} g_i \cdot \phi_{hh}(l_{k-S}, l_i) \\ \cdot \\ \cdot \\ \cdot \\ \psi_{xh}(l_k) - \sum_{i=1}^{k-S-1} g_i \cdot \phi_{hh}(l_{k-S}, l_i) \end{bmatrix} \tag{17}$$

$l_{k-1}, \ldots, l_{k-S}$ and $g_{k-1}, \ldots, g_{k-S}$ in the equation (17) are different from those in (16) and assumed to be indicative of the location and amplitude of a sequence of S pulses close to $l_k$, whereas $l_{k-S-1}, \ldots, l_1$ and $g_{k-S-1}, \ldots, g_1$ represent the location and amplitude of other than them, respectively. As the lefthand side $(S+1)\times(S+1)$ matrix in the equation (17) is positive and symmetric, $g_k$, $k=K-S, \ldots, K$ is obtainable from a fast algorithm such as well known CHOLESKY decomposition. The calculation amount required for solving the linear equations is dependent on the number of unknowns. Since $(S+1)<K$ in the equations (16) and (17), the equation (17) can be solved at a higher speed with the calculation amount smaller than that needed in (16). For instance, the calculation amount required for solving $n\times n$ symmetrical matrix in terms of the CHOLESKY decomposition is in the order of $n^3$. Accordingly, assuming that $(S+1)=k/4$, the equation (17) can be solved with the calculation amount of 1/64 compared with that in the case of (16). When the equation (17) is establishable, $J_k$ can be calculated in the following manner:

$$J_k = \sum_{n=0}^{N-1} x_w^2(n) - \sum_{i=k-S}^{k} g_i \left( \psi_{xh}(l_i) - \sum_{j=1}^{k-S-1} g_i \cdot \phi(l_i, l_j) \right) \tag{18}$$

The process for developing the excitation pulse sequence according to the present invention will be described subsequently.

The first pulse location $l_1$ is determined as $l_1$ maximizing $\psi_{xh}(l_1)/\psi_{hh}(l_1, l_1)$ in the equation (12) where $k=1$. Moreover, the amplitude $g_1$ is given as a maximum value of $\psi_{xh}(l_1)/(\psi_{hh}(l_1, l_1)$.

The second pulse location is determined by substituting $g_1$ and $l_1$ obtained, as described above, into the equation (12) where $k=1$ as $l_2$ maximizing the value obtained from the equation (12) where $k=2$.

More specifically, when the distance between $l_1$ and $l_2$ is smaller than the predetermined value $T_{th}$, i.e., $|l_1-l_2| \leqq T_{th}$, the first pulse is judged existent within the range affecting the second pulse. In this case the first and second pulse amplitudes are obtained by substituting $l_1$ and $l_2$ into the equation (17) where $k=2$, $S=1$. On the other hand, when $|l_1-l_2|>T_{th}$, the first pulse is judged existent within the range not affecting the second pulse. The amplitude of the second pulse is obtainable from the equation (17) where $k=2$, $S=0$ using the (unchanged) $g_1$ obtained beforehand.

Procedures for calculating the k-th ($k\geqq 3$) pulse are similar to that described above. For instance, the k-th pulse location $l_k$ is obtained as the location maximizing the equation (12) into which the pulse positions $l_1, \ldots, l_{k-1}$ and amplitudes $g_1, \ldots, g_{k-1}$ of the first through (k−1)th pulses which have been previously obtained are substituted. Subsequently, $l_k$ thus obtained is compared with the pulse locations $\{l_1, l_2, \ldots, l_{k-1}\}$ determined until then. The number of pulses S, their locations $\{l_i\}$ and $l_k$ satisfying $|l_k-l_i|>T_{th}$ are substituted into the equation (7) to calculate the amplitude $g_k$ at the location $l_k$ and the amplitudes $\{g_i\}$ at the locations $\{l_i\}$ in the neighborhood of $l_k$. In this case, the amplitude of the pulse at the location $l_i$ satisfying $|l_k-l_i|>T_{th}$ will be set as a fixed value and not subjected to change.

Figure 2:
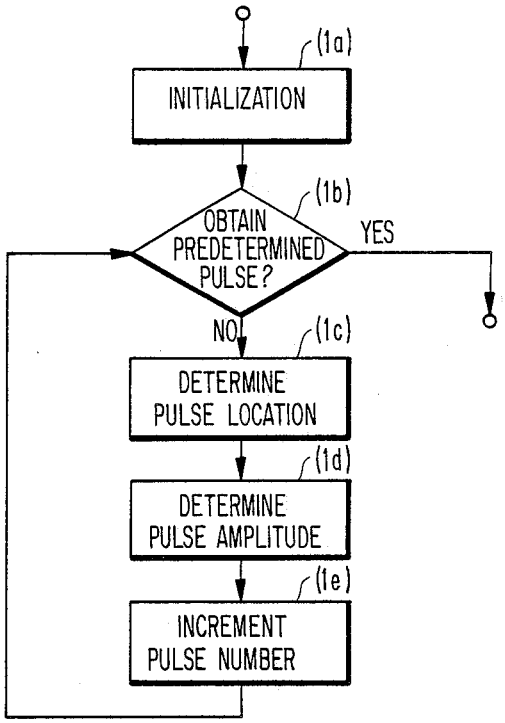
FIG. 2 is a flowchart illustrating a procedure for the operation of the embodiment of the present invention.

The above-mentioned procedure will be summarized as follows (see FIG. 2).

(1a) Setting the initial pulse number at 1.

(1b) Judging whether the pulse number is greater than the predetermined one and terminate the pulse sequence calculation if it is greater.

(1c) Obtaining the pulse location based on the equation of (12).

(1d) Obtaining the amplitude of the pulse sequence involved on the basis of the equation (17).

(1e) Returning to the process (1b) by incrementing the pulse number by one:

The process procedure (1c) comprises the following..

calculating the equation (12) for the first pulse location $l_1$ when $k=1$, i.e., $\psi_{xh}(l_1)/\phi_{hh}(l_1, l_1)$ to obtain $l_1$ maximizing $(\psi_{xh}(l_1)/\phi_{hh}(l_1, l_1))$, in addition, obtaining the amplitude $g_1$ of the first pulse by substituting $l_1$ into the equation (17), where $k=1$, $S=0$;

Obtaining the second pulse location as $l_2$ maximizing the following expression obtained by substituting $g_1$, $l_1$ into the equation (12) where $k=1$.

$$\{\psi_{xh}(l_2)-g_1\phi_{hh}(l_1, l_2)/\phi_{hh}(l_2, l_2)\}^2$$

The amplitudes $g_1$, $g_2$ of the first and second pulses are obtainable from the procedure (1d). When the distance between $l_1$ and $l_2$ determined in the procedure (1c) is smaller than the predetermined value, the amplitudes $g_1$ and $g_2$ can be calculated by substituting $l_1$ and $l_2$ into the equation (17) where $k=2$, $S=1$. The procedure for calculating the amplitudes and locations of the third pulse sequence or above is similar to the foregoing, in that the process is repeated until the number of pulses are determined, the process being for obtaining the location $l_k$ of the k-th pulse from the equation (12) in the procedure (1c) and the amplitude by substituting the thus obtained $l_k$ and the locations of predetermined number S of pulses closer to $l_k$ selected among $l_1, \ldots, l_{K-1}$ which have been determined so far.

In the above description, amplitude adjustment is made for the pulses located in the neighborhood of the k-th pulse location $l_k$ which affect the k-th pulse amplitude determination as well as for the k-th pulse amplitude. In other words, the amplitudes of pulses positioned within the threshold of a distance concept are adjusted. However, it is allowed to set the number of pulses being adjusted at $S=S_o$. Specifically, the amplitudes of k pulses up to $k<S_o+1$ are adjusted by solving the equation (17) where $S=k$, the amplitudes of $S_o$ pulses located closest to $l_k$ are adjusted by solving the equation (17) where $S=S_o$, and other pulse amplitudes are not changed.

FIG. 1 shows a block diagram illustrating the construction of the present invention. The basic construction thereof is roughly similar to those shown in the U.S. patent application Ser. No. 626,949 or Canadian Application No. 458,282 except for the excitation pulse sequence generating circuit 18. The excitation pulse sequence generating circuit 18 is, as above described, sequentially available based on only the pulses located close thereto.

The outline of the construction and operation of the circuit shown in FIG. 1 will be described.

The apparatus has a coder input terminal 10 supplied with a discrete speech signal sequence x(n) of the type thus far described. A buffer memory 11 stores each segment of the discrete speech signal sequence x(n). Responsive to the segment, a K parameter calculator 12 calculates a sequence of K parameters $K_i$ representative of the spectral envelope of the segment as before. It is possible to calculate the K parameter sequence $K_i$ in the manner described in an article by J. Makhoul in Proc. IEEE, Apr. 1975, pages 561 to 580, under the title of "Linear Prediction: A Tutorial Review".

The K parameter sequence is coded by a K parameter coder 13 with a predetermined number of quantization bits into a parameter code sequence $I_i$. The coder 13 may be circuitry described in an article by R. Viswanathan et al. in IEEE Transactions on Acoustics, Speech, and Signal Processing, Jun. 1975, pages 309 to 321, under the title of "Quantization Properties of Transmission Parameters in Linear Predictive Systems".

The coder 13 decodes the parameter code sequence $K_i$ into a sequence of decoded parameters $K_i'$ which correspond to the respective K parameters $K_i$. Responsive to the decoded parameter sequence $K_i'$, a weighting circuit 14 calculates a weighted segment $x_w(n)$ of the type described above.

The decoded parameters $K_i'$ are fed also to an impulse response calculator 15 for use in calculating a sequence of impulse responses h(n). The impulse response calculator 15 for producing the weighted response sequence $h_w(n)$ is in effect a cascade connection of the synthesizing filter and a weighing circuit for the synthesizing filter as described in the herein referenced patent applications. The weighted response sequence $h_w(n)$ is delivered to an autocorrelator 16 for use in calculating an autocorrelation function $\phi_{hh}(l_i, l_j)$ of the weighted response sequence $h_w(n)$ in compliance with Equation (10). On the right hand side of Equation (10), a pair of arguments $(n-l_i)$ and $(n-l_j)$ represents each of various pairs of the sampling instants 0 through $(N-1)$.

The weighted segment $x_w(n)$ and the weighted response sequence $h_w(n)$ are delivered to a cross-correlator 17 for use in calculating a cross-correlation function $\psi_{xh}(l_k)$ therebetween in accordance with Equation (9).

The autocorrelation and the cross-correlation functions $\phi_{hh}(l_i, l_j)$ and $\psi_{xh}(l_k)$ are delivered to the excitation pulse sequence generating circuit 18. The circuit 18 produces a sequence of excitation pulses d(n) in response to the autocorrelation and the cross-correlation functions by successively deciding locations $l_i$ and amplitudes $g_i$ of the excitation pulses as will later be described in detail.

A pulse coder 19 codes the excitation pulse sequence d(n) to produce an excitation pulse code sequence. Inasmuch as the excitation pulse sequence d(n) is given by the locations $l_k$ and the amplitudes $g_k$ of the excitation pulses. On so doing it is possible to resort to known methods. For example, the locations $l_k$ are coded by the run length encoding known in the art of facsimile signal transmission. More particularly, the locations $l_k$ are coded by representing a "run length" between two adjacent excitation pulses by a code dependent on the "run length". The amplitudes $g_k$ may be coded by a conventional quantizer. The amplitudes may be normalized into normalized values by using, for example, a root mean square value of the maximum ones of the amplitudes in the respective segments as a normalizing coefficient. On quantizing, the normalizing coefficient may logarithmically be compressed. Alternatively, the amplitudes may be coded by a method described by J. Max in IRE Transactions on Information Theory, Mar. 1960, pages 7 to 12, under the title of "Quantizing for Minimum Distortion".

A multiplexer 20 multiplexes the parameter code sequence $I_i$ delivered from the coder 13 and the excitation pulse code sequence sent from the pulse coder 19. An output code sequence produced by the multiplexer 20 is supplied to, for example, a transmission channel (not shown) through a coder output terminal 21.

Figure 3:
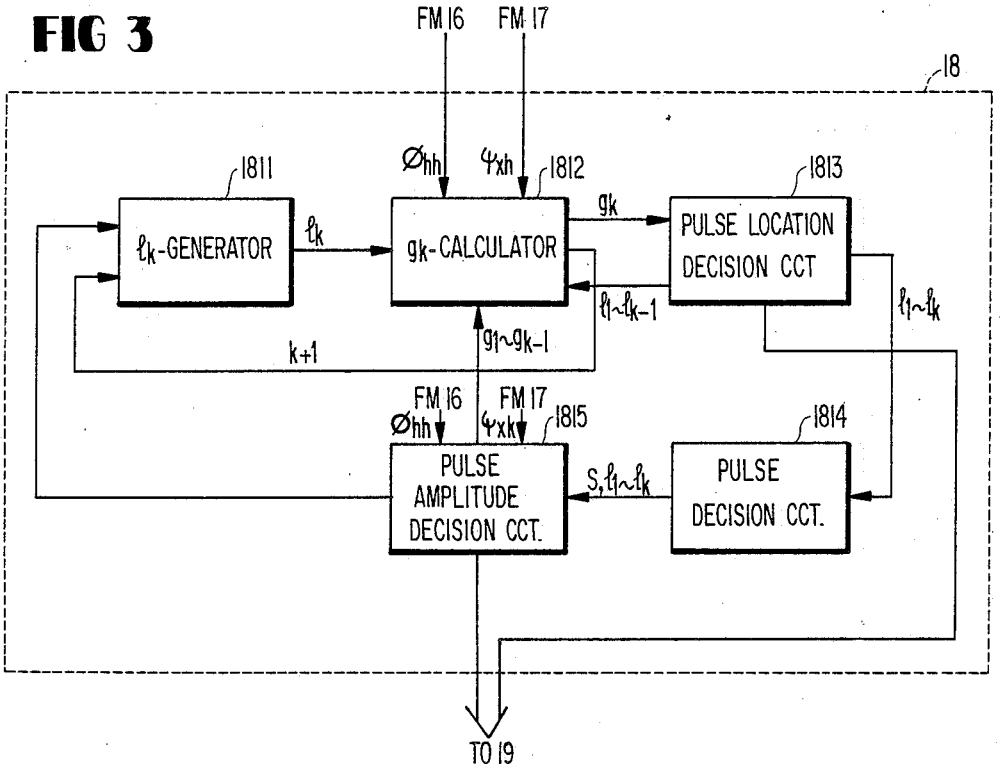
FIG. 3 is a block diagram illustrating an example of the excitation pulse sequence generating circuit 18 shown in FIG. 1.

FIG. 3 shows an example of excitation pulse sequence generating circuit 18.

A pulse amplitude ($g_k$) calculator 1812 for computing the $g_k$ defined by equation (12) are supplied with the signals $\phi_{hh}$ and $\psi_{xh}$ from the auto-correlator 16 and the cross-correlator 17; the pulse location $l_k$ from a pulse location ($l_k$) generator 1811; the pulse location data $l_1 \sim l_{k-1}$ obtained in the past from a pulse location decision circuit 1813; and further the pulse amplitude $g_1 \sim g_{k-1}$ obtained in the past at the above-described pulse location $l_1 \sim l_{k-1}$ from a pulse amplitude decision circuit 1815. The $l_k$ generator 1811 generates the pulse location signal $l_k$ ($k=0 \sim N-1$; N being the number of samples within a frame) corresponding to the number of samples within the frame, whereas the pulse amplitude calculator 1812 performs the calculation of the equation (12) using the signals $l_k$, $\phi_{hh}$, $\psi_{xh}$, $l_1 \sim l_{k-1}$, $g_1 \sim g_{k-1}$ for each pulse location $l_k$ to send $(N-1)$ pieces of the pulse amplitude data $g_k$ to the pulse location decision circuit 1813. For this purpose, the $g_k$ calculator 1812 sends a signal $k+1$ indicative of the next pulse location $l_{k+1}$ to the $l_k$ generator circuit 1811. The pulse location decision circuit 1813 searches a maximum value among (N−1) pieces of the amplitude data $g_k$ thus obtained to determine the pulse location data $l_k$ as the k-th pulse location, thereby sending the determined location data $l_k \sim l_{k-1}$ to the calculator 1812. A neighbouring pulse decision circuit 1814, upon receipt of the thus obtained pulse location data $l_1 \sim l_k$, sends the pulse number S, those locations $\{l_i\}$ and $l_k$ satisfying $$|l_k - l_i| \leqq T_{th}$$

to the pulse amplitude decision circuit 1815. The pulse amplitude decision circuit 1815 operates to calculate the equation (17) based on the data to obtain a new pulse amplitude data. In this case, the pulse amplitude at the location $l_i$ of $|l_k - l_i| > T_{th}$ is not regarded as an object for the pulse amplitude alteration (calculation) but a fixed value. The pulse amplitude decision circuit 1815 applies the thus obtained amplitude data $g_1 \sim g_{k-1}$ to the $g_k$ calculator 1812 and then resets the $l_k$ generator circuit 1811 with the signal R to obtain the subsequent (k+1)th pulse through the above-described procedure.

After the location data $l_k$ and amplitude data $g_k$ of the predetermined number of the pulses are obtained, they are applied to the coder 19 of FIG. 1 from the pulse location decision circuit 1813 and the pulse amplitude decision circuit 1815 as the excitation pulse d(n), respectively.

A second embodiment of the present invention will be described.

An algorithm for obtaining the amplitude $g_k$ and location $l_k$, k=1, . . . K of an excitation pulse sequence minimizing J in the equation (7) is as follows:

The sequential pulse search method according to the present invention obtains the location $l_k$, amplitudes $g_k$ and $\{g_k\}$ by changing $l_k$ with adjusting $\{g_k\}$ and $g_k$ under the assumption that $l_1, \ldots, l_k$ are fixed. In other words, $l_k$ is determined on the basis of the assumption that the equation (19) as only a function of $l_k$ and a group of pulses $\{l_k\}$ located close thereto. Exponential attenuation of the impulse response sequence h(n) makes this assumption valid.

A weighted mean squared error $J_k$ when one pulse is added to a (k−1) pulse sequence whose locations $\{l_1, \ldots, l_{k-1}\}$ and amplitudes $\{g_1, \ldots, g_{k-1}\}$ are fixed is now expressed and defined as the following equation:

$$J_k = \sum_{n=0}^{N-1} \left\{ x_w(n) - \sum_{i=1}^{K} g_i h_w(n - l_i) \right\}^2 \tag{19}$$

$J_k$ is a function of $l_k$, $\{l_k\}$ and $\{g\}$, *therefore, the equation* (19) can be written as follows:

$$J_k(l_k; \{g_k\}_{near}) = \sum_{n=0}^{N-1} \left( x_w(n) - \sum_{i=1}^{K} g_i h_w(n - l_k) \right)^2 \tag{20}$$

where $\{g_k\}$ near is indicative of the amplitude of a pulse near the $l_k$.

The present invention is thus intended to obtain the excitation pulse sequence sequentially based on the minimization of $J_k(l_k; \{g_k\}_{near})$.

The first pulse is defined with $l_1$ and $g_l$ minimizing the following equation, $$J_1(l_1, g_1) = \sum_{n=0}^{N-1} (x_w(n) - g_1 h_w(n - l_j))^2$$

Figure 4:
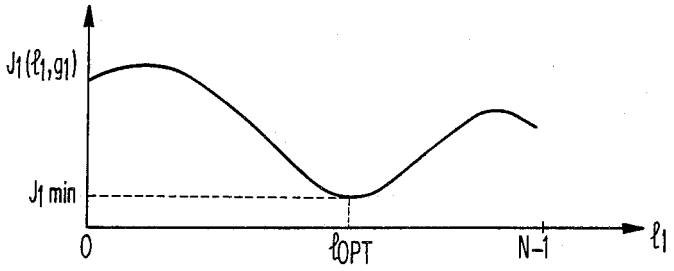
FIG. 4, FIGS. 5A and 5B, FIGS. 6A and 6B are graphs illustrating the operational principles of the example shown in FIG. 3.

In FIG. 4 the least value of $J_1$ is obtained by changing $g_1$ for given $l_1$. The location $l_1$ and amplitude $g_1$ to be determined in FIG. 4 are $l_{opt}$ and $g_1$ giving $J_{1\ min}$.

Figure 5A:
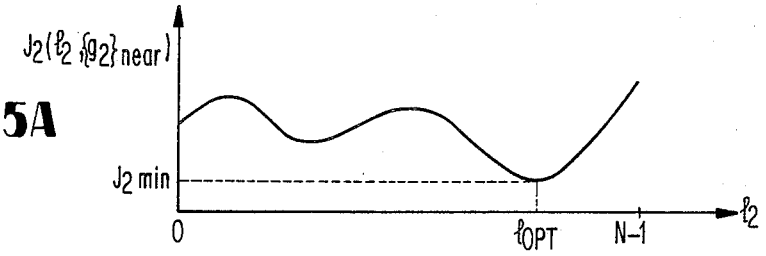

The second pulse is determined based on the minimization of $J_2$ ($l_2\{g_2\}_{near}$) in the equation (20). $\{g_2\}_{near}$ means $\{g_1, g_2\}$ if $|l_1 - l_2| \leqq T_{th}$ and $\{g_2\}$ if $|l_1 - l_2| > T_{th}$, respectively. In FIG. 5A, there is shown a minimum value of $J_2$ ($l_2$, $\{g_2\}_{near}$) as a function of $l_2$ obtained by changing $g_1$ and $g_2$ if $|l_1 - l_2| \leqq T_{th}$ and changing $g_2$ if $|l_1 - l_2| > T_{th}$. In FIG. 5A, the location $l_k$ and $\{g_k\}_{near}$ are $l_{opt}$ and the $\{g_k\}_{near}$ giving $J_{2\ min}$. It is to be noted here that the pulse amplitude at $l_j$ satisfying $|l_1 - l_2| > T_{th}$ will not change.

Figure 5B:
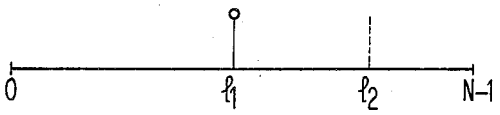

FIG. 5B shows the relationship between the thus obtained first and second pulses.

Figure 6A:
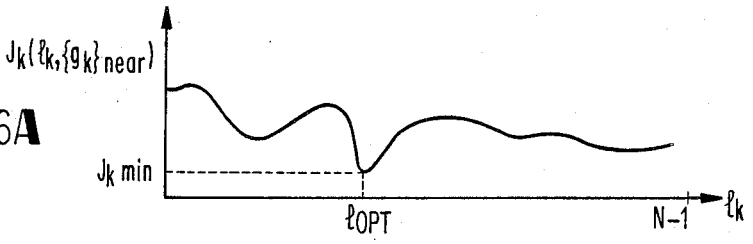

In the same manner, the k-th pulse location $l_k$ and amplitude $g_k$ in FIG. 6A illustrating the minimum value of $J_k$ ($l_k$, $\{g_k\}_{near}$) as a function of $l_k$ are the location $l_k$ giving the minimum value $J_{k\ min}$ and $J_{k\ min}$ giving the $\{g_k\}$ value, respectively.

Figure 6B:
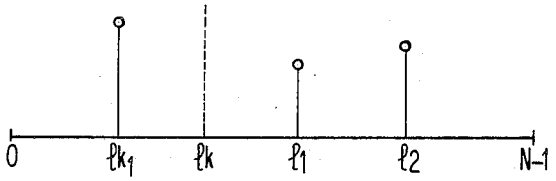
Figure 7:
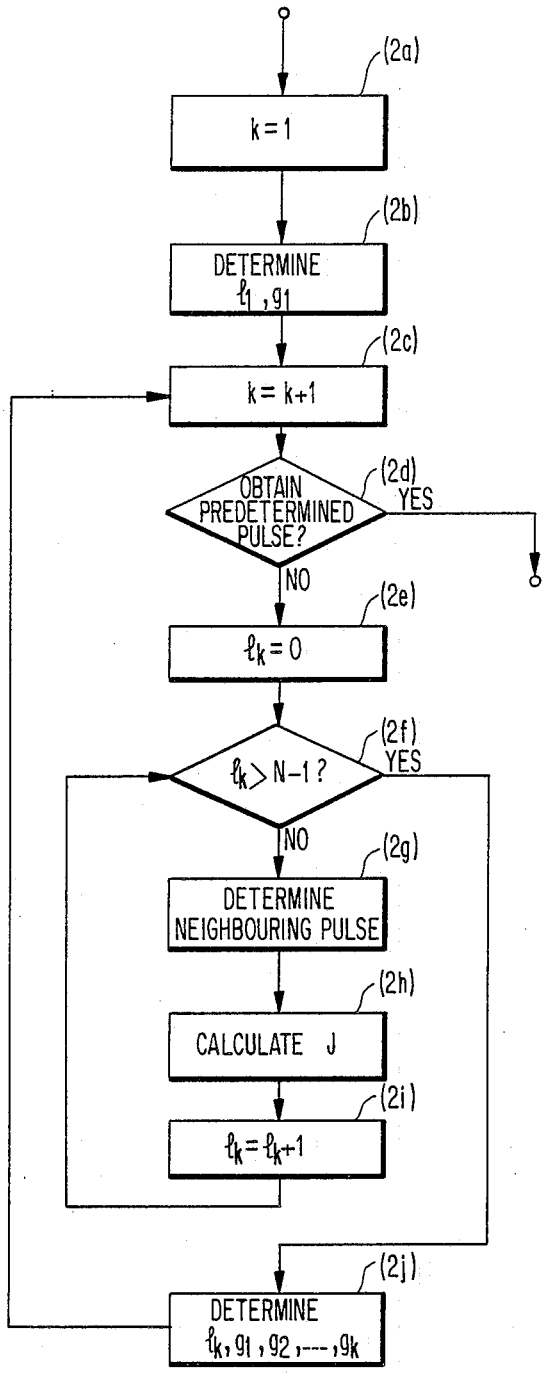
FIG. 7 is a flowchart illustrating a procedure for the operation of another embodiment of the present invention.

When $l_k$ is given, $\{g_k\}_{near}$ minimizing $J_k$ ($l_k$, $\{g_k\}_{near}$) is determined by the following equation (21) wherein $J_k$ ($l_k$, $\{g_k\}_{near}$) in the equation (20) is partially differentiated with $\{g_k\}_{near}$ and set at zero. However, pulses positioned at $l_j$ which do not satisfying $|l_{opt} - l_j| \leqq T_{th}$, j=1, . . . , k−1 are unchangeable. FIG. 6B shows the relationship between the (k−1)th pulse location $l_1 \sim l_{k-1}$ and the k-th pulse location $l_k$.

$$\psi_{xh}(l_i) - \sum_{j=1}^{k-S-1} g_j \phi_{hh}(l_1, l_j) = \sum_{j=k-S}^{K} g_i \phi_{hh}(l_1, l_j) \tag{21}$$
$$i = k - S, \ldots S$$

where S=number of pulses positioned close to $l_k$; $\{l_{k-s}, l_{k-s+1}, \ldots, l_k\}$ and $\{g_{k-s}, \ldots, g_k\}$=pulse location and amplitude constituting $\{g_k\}_{near}$; and $\{l_1, l_2, \ldots, l_{k-S-1}\}$ and $\{g_1, g_2, \ldots, g_{k-S-1}\}$=location and amplitude of pulses other than $\{g_k\}_{near}$.

When the equation (21) is satisfied, $J_k$ ($l_k$,$\{g_k\}_{near}$) can be written as:

$$J_k(l_k, \{g_k\}_{near}) = \tag{22}$$
$$\sum_{n=0}^{N-1} x^2{}_w(n) - \sum_{i=k=s}^{k} g_i \left( \psi_{xh}(l_i) - \sum_{j=1}^{k-S-1} g_i \phi_{hh}(l_i, l_j) \right)$$

In the second embodiment of the present invention, although $\{g_k\}_{near}$ has been determined by providing a threshold in between pulses, the $\{g_k\}_{near}$ may be determined by fixing the number of pulses constituting the $\{g_k\}_{near}$; that is, $l_k$ is obtained by regulating the pulse positioned at $l_k$ and S pieces of those located close to $l_k$.

The pulse determining procedure according to the above-described second embodiment of the present invention may be summarized as follows:

(2a) The number of pulses desired is initially set at 1 (k=1);

(2b) When the value $g_1 = \psi_{xh}(l_1) / \phi_{hh}(l_1, l_1)$ with k=1 according to the equation (20) is added to $$J_1 = \sum_{n=0}^{N-1} x^2{}_w(n) - g_1\,\psi_{xh}(l_1)$$

$l_1$ and $g_1$ are calculated to minimize $J_1$ or to maximize $\psi_{xh}(l_1)/\phi_{hh}(l_1, l_1)$;

(2c) The pulse number is incremented by 1;

(2d) The pulse number is compared with the predetermined sequence and the pulse inducing operation is terminated when that number is reached;

(2e) $l_k=0$ through the initialization of the pulse location $l_k$ being determined;

(2f) $l_k$ is judged whether it is greater or smaller than $N-1$ and, if it is greater than $N-1$, transferred to (2j) to be dealt with therein;

(2g) The equation (20) is utilized to compute the amplitudes of S pulses at the predetermined locations closer to $l_k$ in terms of the distance between the $l_k$ and $l_1, l_2, \ldots, l_{k-1}$. However, those of the pulse at the predetermined locations far from $l_k$ in terms thereof are kept unchanged.

(2h) The amplitudes $g_1, g_2, \ldots, g_k$ obtained from the locations $l_1, l_2, \ldots, l_k$ and (2g) are added to the equation (21) to calculate J then; (2i) $l_k=l_k+1$ and return to the process (2f); and;

(2j) Among $J_k$ corresponding to each $l_k=0$ up to $l_k=N-1$ obtained from (2h), $l_k$ and $g_1, g_2, \ldots, g_k$ capable of providing the smallest J are obtained and return to the process (2c).

Figure 8:
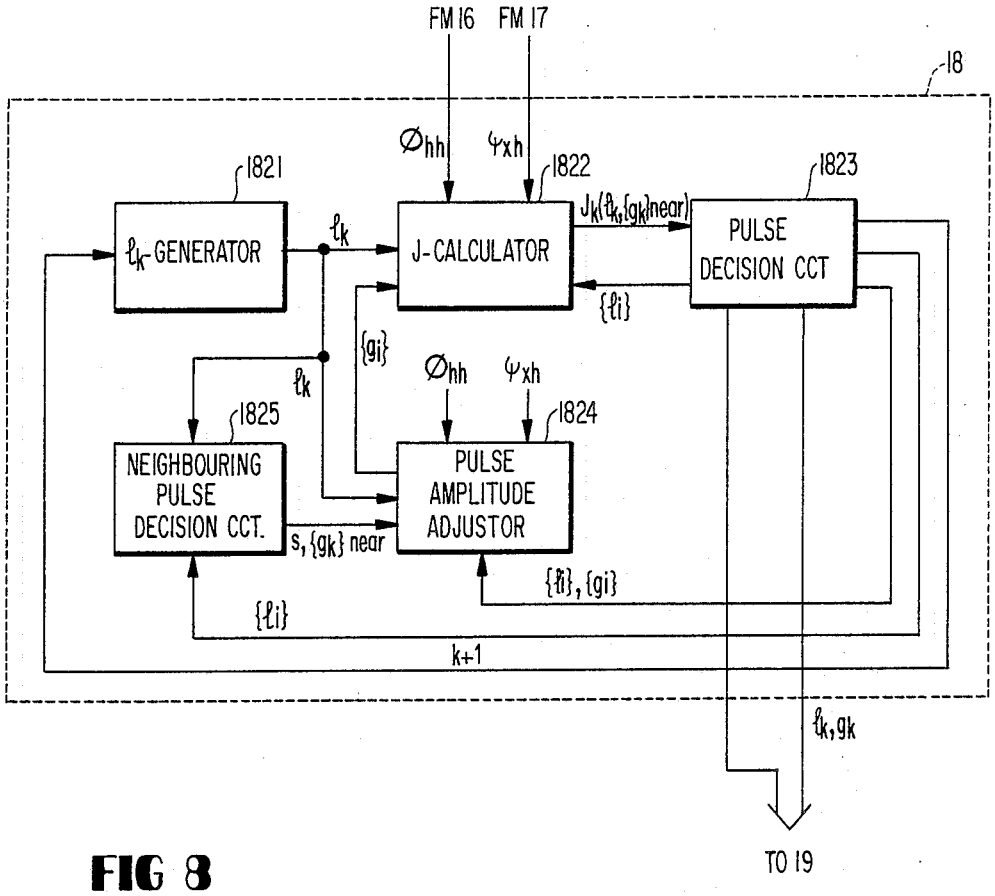
FIG. 8 is a block diagram illustrating another example of the excitation pulse sequence generating circuit shown in FIG. 1.

FIG. 8 is a block diagram of a pulse derivation circuit (corresponding to the block 18 in FIG. 1) according to the second embodiment of the present invention.

An $l_k$ generator circuit 1821 generates a signal $l_k$ ($k=0\sim N-1$) indicative of a pulse location corresponding to the sample number within a frame 1. A square error J calculator 1822 receives signals $\phi_{hh}$ and $\psi_{xh}$ from the correlators 16 and 17 (in FIG. 1), $l_k$ from the $l_k$ generator 1821 and amplitudes $\{g_i\}$ and locations $\{l_i\}$, $i=1, \ldots, k$, from an amplitude regulator 1824 and a pulse decision circuit 1823 described later and operates to calculate $J_k(l_k\{g_k\}_{near})$ in the equation (22). Since $$\sum_{n=0}^{N-1} x^2{}_w(n)$$

in the equation (21) is a constant, it is assumed zero. The pulse decision circuit 1823 compares $J_k$ ($l_k$, $\{g_k\}_{near}$) obtained in 1822 for $l_k$ ranging 0 to $N-1$ and determines $l_k$, $\{g_k\}_{near}$ giving a minimum value $J_{k\,min}$. This circuit 1823 supplies the excitation pulse location $l_k$ and amplitude $g_k$ obtained to the coder 19 when the number of excitation pulse reaches a predetermined value. The circuit 1823 also supplies a numerical signal $(k+1)$ specifying the $(k+1)$the new pulse location to the $l_k$ generator circuit 1821 to generate the $(k+1)$th pulse location therefrom. Upon receipt of the then determined pulse location $\{l_k\}$ and amplitude $\{g_i\}$, $i=1, \ldots, k-1$ from the pulse decision circuit 1823, $l_k$ from the $l_k$ generator circuit 1821, data of pulses (the number S) located close to $l_k$ from a neighboring pulse decision device 1825 described later, and further $\psi_{xh}(\cdot)$ and $\phi_{hh}(\cdot)$, a pulse amplitude adjusting circuit 1824 operates to solve the equation (21) to obtain $\{g_k\}_{near}$ and send the results to the J calculator 1822. The neighboring pulse calculator 1825 receives the signal $l_k$ from the $l_k$ generator 1821 and determines the number S of pulses positioned close to $l_k$ based on the pulse location $\{l_i\}$, $i=1, \ldots, k-1$ supplied from the pulse decision circuit 1823.

The following will subsequently relate to an effective excitation pulse determining algorithm making use of the CHOLESKY decomposition for solving the linear equation (21).

The equation (21) will be expressed in the following form (CHOLESKY decomposition):

$$\vec{V}\vec{D}\vec{V}\vec{g}=\vec{f} \tag{23}$$

where $\vec{V}$ is a $(S+1)\times(S+1)$ low triangular matrix, $\vec{D}$ a $K\times K$ diagonal matrix, $\vec{g}$ a column vector whose i-th element is $g_{k-S-1-+i}$, $\vec{f}$ a column vector whose i-th element is $\psi_{xh}(l_{k-S-1+i})$, and superscript t on a matrix stands for transpose.

If the (i, j) element of $\vec{V}$ is expressed as $v_{ij}$ and the (i, j) element of $\vec{D}$ is expressed as $d_i$, $$\begin{bmatrix} \phi_{hh}(m_1, m_1) & \cdots & \phi_{hh}(m_1, m_{S+1}) \\ \phi_{hh}(m_2, m_1) & \cdots & \phi_{hh}(m_2, m_{S+1}) \\ \vdots & & \vdots \\ \phi_{hh}(m_{S+1}, m_1) & \cdots & \phi_{hh}(m_{S+1}, m_{S+1}) \end{bmatrix} = \tag{24}$$

$$\begin{bmatrix} 1 & & & & & \\ V_{21} & 1 & & & & \\ V_{31} & V_{32} & 1 & & & \\ \vdots & \vdots & \vdots & \ddots & & \\ V_{(S+1)1} & V_{(S+1)2} & V & \cdots & \cdots & 1 \end{bmatrix} \begin{bmatrix} d_1 & & & & \\ & d_2 & & & \\ & & d_3 & & \\ & & & \ddots & \\ & & & & d_{S+1} \end{bmatrix} \begin{bmatrix} 1 & V_{21} & V_{31} & \cdots & V_{(S+1)1} \\ & 1 & V_{32} & \cdots & V_{(S+2)2} \\ & & 1 & \cdots & V_{(S+3)3} \\ & & & \ddots & \vdots \\ & & & & 1 \end{bmatrix}$$

where $m_i$, $i=1, \ldots, S+1$ is equal to $l_{k-S+i}$ in equation (21), that is, $$m_i=l_{k-S-1+i},\ i=1, \ldots, S+1 \tag{25}$$

From equation (24), there exists the following recursive relations among element of $\vec{V}$ and $\vec{D}$, $$\begin{cases} v_{11} = 1 \\ v_{ij} = \left\{ \phi_{hh}(m_i, m_j) - \sum_{k-1}^{j-1} v_{ik} d_k V_{jk} \right\} / d_j, \end{cases} \quad (26)$$

$$1 \leqq j \leqq i-1,\ 2 \leqq i \leqq S+1$$

$$\begin{cases} d_1 = 1 \\ d_i = \phi_{hh}(m_i, m_i) - \sum_{k=1}^{i-1} v_{ik} d_k, \end{cases} \quad (27)$$

$$2 \leqq i \leqq S+1$$

Further if $\vec{V}\ \vec{g}\ \vec{f}$, $\vec{g}$ are expressed as $$\vec{g} = \vec{V}\vec{D}^{-1}\vec{Y} \quad (28)$$

Accordingly, the weighted mean squared error $J_k$ $(l_k\{g_k\}_{near})$ can be expressed in terms of elements of $\vec{D}$ and $\vec{Y}$ by $$\begin{aligned} J_k(l_k, \{g_k\}_{near}) &= \sum_{n=0}^{N-1} x^2{}_w(n) - \vec{g}^t\vec{f} \\ &= \sum_{n-0}^{N-1} x^2{}_w(n) - \vec{Y}^t\vec{D}^{-1}\vec{Y} \\ &= \sum_{n=0}^{N-1} x^2{}_w(n) - \vec{Y}^t\vec{D}^{-1}\vec{Y} \\ &= \sum_{n-0}^{N-1} x^2{}_w(n) - \sum_{i=1}^{S+1} y_i^2/d_i \end{aligned} \quad (29)$$

where if $|l_i - l_j|$ is large, the effect of $\phi_{hh}(l_1, l_j)$ on $J_k(l_k, \{g_k\}_{near})$ is negligible, so that a term of $\phi_{hh}(l_i, l_j)$ in the case of $|l_i - l_j| \leqq T_{th}$ is assumed to be zero in equation (29). Moreover, $\{y_i\}$, $i=1, \ldots, S+1$ are elements of the row vector $\vec{Y}$ and has the following relation.

$$\begin{cases} y_1 = \psi_{xh}(m_1) \\ y_i = \psi_{xh}(m_i) - \sum_{j=1}^{i-1} v_{ij} Y_j,\ 2 \leqq i \leqq S+1 \end{cases} \quad (30)$$

The excitation pulse location $l_k$, $k=1, \ldots, K$ is sequentially obtained using the recursive relations of (26), (27), (29) and (30).

When the k-th pulse location $l_k$ is obtained, since $l_1, \ldots, l_{k-1}$ has been determined, elements from the upper S rows in D and Y are obtainable. Consequently, the k-th location minimizing $J_k(l_k, \{g_k\}_{near})$ of the equation (29) is determined at the location where the following equation is maximized.

$$y_{S+1}^2/d_{S+1} = \left\{ \psi_{xh}(l_k) - \sum_{j=1}^{S} v_{ij} y_j \right\}^2 / \left\{ \phi_{hh}(l_k, l_k) - \sum_{j=1}^{S} v_{(S+1)j}^2 d_j \right\} \quad (31)$$

$$0 \leqq l_k \leqq N-1,\ l_k \neq l_j,\ j = 1, \ldots, k-1.$$

The elements of $\vec{V}$, $\vec{D}$ and $\vec{Y}$ being determined, $\vec{g}$ will be obtained from the following relation:

$$\begin{cases} g_k = y_{S+1}/d_{S+1} \\ g_{k-S-1+i} = y_i/d_i - \sum_{j=i+1}^{S+1} v_{ji}\, g_{k-S-1+j}, \end{cases} \quad (32)$$

$$1 \leqq i \leqq S+1$$

The above-described embodiment will be described in detail using flowcharts.

Figure 9:
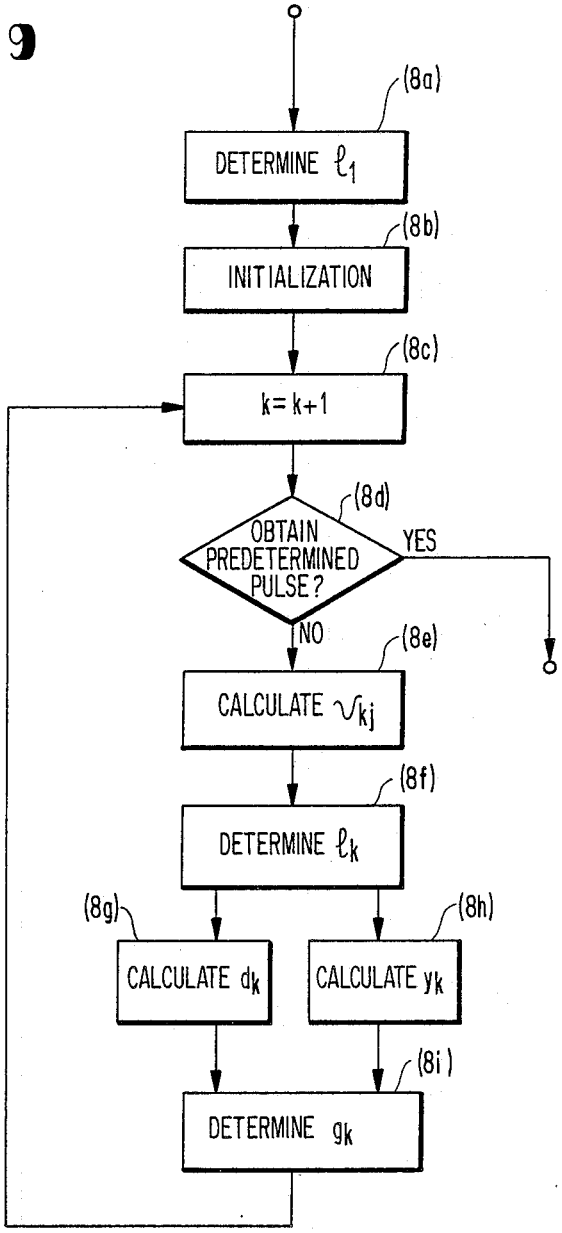
FIG. 9 is a flowchart illustrating a procedure for the operation of still another embodiment of the present invention.

In FIG. 9, (8a) is intended to obtain the $l_1$ giving the maximum value of $\psi_{xh}^2(l_1)/\psi_{hh}(l_1, l_1)$ in the equation (31) where $k=1$, $S=0$, and in (8b) an initial value of $v_{11}$, $d_1$, $y_1$ are set on the basis of the equations (26), (27) and (30) using $l_1$ obtained by (8a). In (8c) the number of pulses is increased by one, whereas in (8d) the number of pulses incremented in (8c) is judged whether it is greater than a predetermined number or not and if greater, the calculation procedure to determine the pulse location is stopped. Procedure (8e) is employed to calculate the elements of $\vec{v}$ according to the equation (26). In (8f) the pulse location $l_k$ providing the maximum value for the above-described equation (31) is determined. In (8g) the elements of $\vec{D}$ are calculated according to the equation (27). Procedure (8h) is also used to calculate elements of $\vec{Y}$ according to the equation (30). In (8i), the pulse amplitude is calculated based on the equation (3) and the next step is the process (8c).

As described up to now, the present invention is intended to make possible high quality speech analysis as well as synthesis with a reduction in the calculation amount by using as basic data only pulses positioned close to those being noted at present among those obtained in the past. Accordingly, it is understood that examples other than the above-described embodiments are obviously considered.

Figure 10:
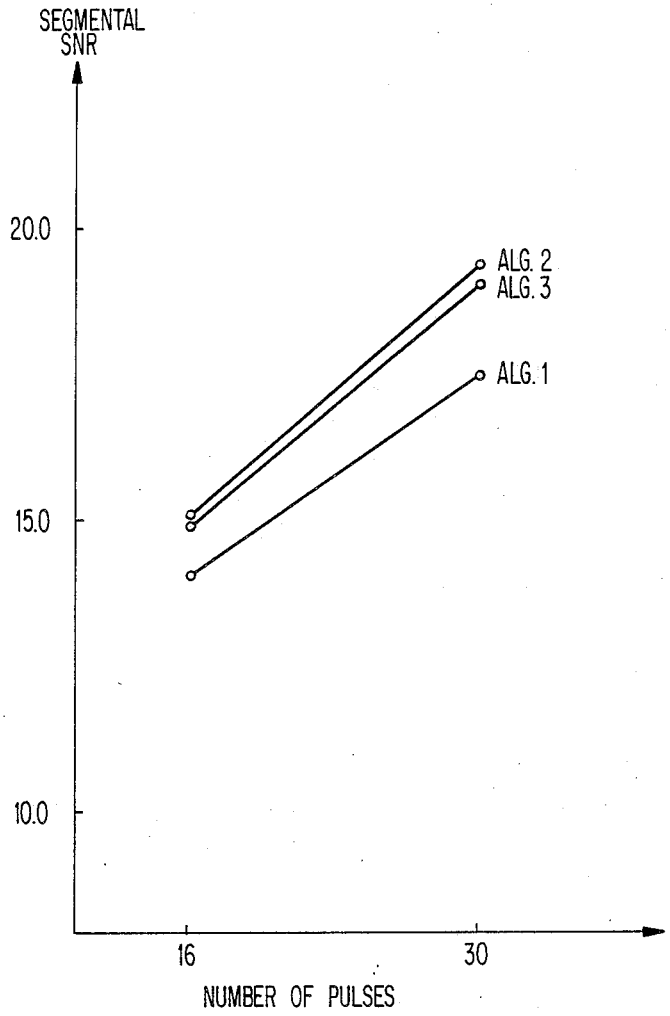
FIG. 10 is a graph illustrating the effects of the present invention relative to SNR in comparison with the conventional methods.

In FIG. 10, there is shown a relationship between a geometrical mean SNR and the number of pulses to be determined. ALG.1 indicates the relationship obtained by the prior art 2. ALG.2 and ALG.3 represent the relationships obtained by the present invention (first embodiment) where the numbers of pulses to be determined are 2 and 1 within a constant distance, respectively. It will be apparent from FIG. 10 the improvement in SNR is remarkable. Further improvement may be attained according to the second embodiment since the number of data utilized for the pulse determination is increased.

Although the excitation pulse sequence calculation according to the present invention has been made on a frame basis, it may be made on a subframe basis by dividing the frame into subframes. Assuming the number of subframes to be d according to the above arrangement, the segment distance where the pulse is searched will become 1/d and the calculation amount required for the pulse search will be also reduced to roughly 1/d. Moreover, even if the calculation for determining the pulse location is made at high speed according to the present invention, it will be dependent on the order of the square of the pulse number. The number of pulses per subframe can effectively be reduced by dividing the frame into subframes.

The frame length may be variable, in that the characteristics can be improved. Another known parameter (for instance LSP parameter and the like) may also be usable instead of the K parameter representing the short time speech signal sequence spectrum envelope. Moreover, the above-described weighting function w(n) may be dispensed with.

In the excitation pulse sequence calculating equation (13) according to the present invention, although the auto-correlation function has been computed according to the equation (10) to obtain $\psi_{hh}(\cdot)$, it may be arranged to calculate an auto-correlation function according to the following equation:

$$\phi_{hh}(l_i, l_j) = \sum_{n-1}^{N-|l_i-l_j|+1} h_w(n)h_w(n - |l_i - l_j|), \quad (37)$$

$$0 \leqq |l_i - l_j| \leqq N - 1$$

Thus it becomes possible with such an arrangement to greately reduce the calculation amount required to calculate $\phi_{hh}(\cdot)$ and the total calculation amount.

In calculating the auto-correlation function of the synthesis filter according to the present invention, although the calculation has been made according to the equation (10) after the impulse response of the filter is obtained once, the auto-correlation function train may be obtained by subjecting the power spectrum of the synthesis filter to inverse Fourier transformation. In addition, the calculation of the cross-correlation function can be obtained by subjecting the production of the power spectrum of the synthesis filter and that of the input speech signal to the inverse Fourier transformation.

What is claimed is:

1. A speech band signal coding method for developing sequentially a sequence of excitation pulses, each having different location information from the location information of the other pulses and each having amplitude information, representing an excitation signal of said speech band signal from pulses previously developed on a frame basis, said method comprising:

a location determining step for determining a location of a new pulse by using said pulses previously developed;

a selecting step for selecting the pulses located within a distance shorter than the length of said frame from the location of said new pulse from among said pulses previously developed;

an amplitude determining step for determining the amplitudes of said new pulse and the selected pulses by using the information of said new pulse and said selected pulses; and a coding step for coding the pulses thus determined.

2. A coding method comprising:

a first step for dividing a discrete speech band signal sequence at short time intervals to obtain a short time speech band signal sequence;

a second step for extracting a parameter representing a spectrum envelope of the speech band signal from said short time speech band signal sequence;

a third step for calculating an auto-correlation function train of an impulse response sequence developed from said spectrum envelope and a cross-correlation function train between said impulse response sequence and said short time speech band signal sequence;

a fourth step for determining sequentially a location of a new excitation pulse of excitation pulses representing an excitation signal of said short time speech band signal by using excitation pulses previously developed, said location of said new excitation pulse being different from the locations of the other excitation pulses having been previously developed;

a fifth step for selecting the excitation pulses located within a distance shorter than said short time period length from the location of said new pulse from among the excitation pulses previously determined;

a sixth step for determined the amplitudes of said new excitation pulse and the selected excitation pulses; and a seventh step for coding thus developed excitation pulses.

3. A coding method for developing sequentially a new location and a new amplitude of each of excitation pulses representing an excitation signal of a speech band signal based on the pulse locations and amplitudes previously obtained and cooling the obtained pulses on a frame basis, said new location being different from the locations of excitation pulses previously obtained, said method comprising the steps of:

setting a new location of a new excitation pulse to be determined at one of a plurality of locations within said frame;

selecting excitation pulses located within a distance shorter than said frame length from said new location; and determining a location and an amplitude of the new excitation pulse to be determined and amplitudes of the selected excitation pulses so as to minimize a difference error between said speech band signal and a reproduction signal reproduced by using said new excitation pulse and at least the selected pulses previously obtained.

4. A coding apparatus for developing sequentially a new location and a new amplitude of each of excitation pulses representing an excitation signal of a speech band signal based on the pulse locations and amplitudes previously obtained and coding the obtained pulses on a frame basis, said new location being different from the locations of excitation pulses previously obtained, said apparatus comprising:

a first means for setting a new location of a new excitation pulse to be determined at one of a plurality of locations within said frame;

a second means for selecting excitation pulses located within a distance shorter than said frame length from said new location; and a third means for determining a location and an amplitude of the new excitation pulse to be determined and amplitudes of the selected excitation pulses so as to minimize a difference error between said speech band signal and a reproduction signal reproduced by using said new excitation pulse and at least the selected pulses previously obtained.

5. A coding method for developing sequentially a sequence of excitation pulses, each having location information different from the location information of the other excitation pulses and each having amplitude information, representing an excitation signal of a speech band signal from pulses previously developed on a frame basis, said method comprising:

a location determining step for determining a location of a new pulse by using said pulses previously developed;

a selecting step for selecting the pulses of at most specified number which are the closest to said new pulse from among the pulses previously developed;

an amplitude determining step for determining the amplitudes of said new pulse and the selected pulse by using the information of said new pulse and said selected pulses; and a coding step for coding the pulses thus determined.

6. A coding method comprising:

a first step for dividing a discrete speech band signal sequence at short time intervals to obtain a short time speech band signal sequence;

a second step for extracting a parameter representing a spectrum envelope from said short time speech band signal sequence;

a third step for calculating an auto-correlation function train of an impulse response sequence developed from said spectrum envelope and a cross-correlation function train between said impulse response sequence and said short time speech band signal sequence;

a fourth step for determining sequentially a location of a new excitation pulse of excitation pulses representing an excitation signal of said short time speech band signal by using excitation pulses previously developed, said location of the new excitation pulse being different from the locations of the excitation pulses previously developed;

a fifth step for selecting the excitation pulses from a limited number of pulses closest to said new pulse from among the excitation pulses previously determined; and a sixth step for determining the amplitude of said new excitation pulse previously determined; and a seventh step for coding thus developed excitation pulses.

7. A coding method for developing sequentially a new location and a new amplitude of each of excitation pulses representing an excitation signal of a speech band signal based on the pulse locations and amplitudes previously obtained and coding the obtained pulses on a frame basis, said location of the new excitation pulse being different from the locations of the excitation pulses previously developed, said method comprising the steps of:

setting a new location of a new excitation pulse to be determined at one of a plurality of locations within said frame;

selected the excitation pulses of at most specified number which are the closest to said new pulse location; and determining a location and an amplitude of the new excitation pulse to be determined and amplitudes of the selected excitation pulses so as to minimize a difference error between said speech band signal and a reproduction signal reproduced by using the new excitation pulse and at least the selected pulses previously obtained.

8. A coding apparatus for developing sequentially a new location and a new amplitude of each of excitation pulses representing an excitation signal of a speech band signal based on the pulse locations and amplitudes previously obtained and coding the obtained pulses on a frame basis, said new location being different from the locations of excitation pulses previously obtained, said apparatus comprising:

a first means for setting a new location of a new excitation pulse to be determined at one of a plurality of locations within said frame;

a second means for selecting from the excitation pulses a number of excitation pulses less than the total number of said excitation pulses and at most a specified number thereof which are the closest to said new pulse location; and a third means for determining a location and an amplitude of the new excitation pulses to be determined and amplitudes of the selected excitation pulses so as to minimize a difference error between said speech band signal and a reproduction signal reproduced by using the new excitation pulse and at least the selected pulses previously obtained.

* * * * *

UNITED STATES PATENT AND TRADEMARK OFFICE

CERTIFICATE OF CORRECTION

PATENT NO. : 4,964,169

DATED : 10/16/90

INVENTOR(S) : Ono et al

It is certified that error appears in the above-identified patent and that said Letters Patent is hereby corrected as shown below:

Column 5, line 9, change "gK" to --$g_K$"--.

Column 6, line 10, change "ψhh" to --φhh--;

Column 6, line 12, change "(ψhh" to --(φhh--;

Column 12, line 28, change "$\vec{V}\vec{D}\vec{V}\vec{g}=\vec{f}$" to --$\vec{V}\vec{D}\vec{V}^t\vec{g}=\vec{f}$;

Column 14, line 12, change "ψhh" to --φhh--;

UNITED STATES PATENT AND TRADEMARK OFFICE

CERTIFICATE OF CORRECTION

PATENT NO. : 4,964,169

DATED : 10/16/90

INVENTOR(S) : Ono et al

It is certified that error appears in the above-identified patent and that said Letters Patent is hereby corrected as shown below:

Column 16, line 17, change "cooling" to --coding--.

Signed and Sealed this

Fifth Day of January, 1993

*Attest:*

DOUGLAS B. COMER

*Attesting Officer*

*Acting Commissioner of Patents and Trademarks*